United States Patent [19]

Oughton et al.

[11] 4,011,568

[45] Mar. 8, 1977

[54] ELECTROPHOTOGRAPHIC CAMERA

[75] Inventors: Charles D. Oughton, Interlochen, Mich.; Edward T. Bradley, Caledonia, Wis.

[73] Assignee: Colorkrome, Inc., Traverse City, Mich.

[22] Filed: Nov. 1, 1974

[21] Appl. No.: 519,930

[52] U.S. Cl. ..... 354/3; 355/3 R

[51] Int. Cl.[2] ..... G03G 15/00

[58] Field of Search ..... 354/3, 4; 96/1 R; 118/637; 355/3 R

[56] References Cited

UNITED STATES PATENTS

| | | | |
|---|---|---|---|
| 2,221,776 | 11/1940 | Carlson | 355/3 R X |
| 2,831,409 | 4/1958 | Bixby et al. | 355/3 R |
| 3,247,007 | 4/1966 | Oliphant | 118/637 X |
| 3,528,355 | 9/1970 | Blackert | 354/3 |
| 3,542,465 | 11/1970 | Pundsack et al. | 355/3 R |
| 3,583,807 | 6/1971 | Pollock | 355/4 |
| 3,592,115 | 7/1971 | Ando | 354/3 X |
| 3,798,029 | 3/1974 | Saklikar | 354/3 X |
| 3,864,035 | 9/1973 | Kuehnle | 354/3 X |

*Primary Examiner*—John Gonzales

*Attorney, Agent, or Firm*—Price, Heneveld, Huizenga & Cooper

[57] ABSTRACT

A compact electrophotographic camera for use in conjunction with an electrophotographic print having an electrically charged electrophotoconductive surface with the charged surface being covered with a sheet of dielectric material. As the print is advanced in the camera, the dielectric protective cover is stripped away by reverse passage over a roll. The electrophotographic print is then located on a support in the field of vision of the lens and is exposed. The sheet is then advanced to a toner applicator and is subsequently advanced out of the camera.

6 Claims, 11 Drawing Figures

ELECTROPHOTOGRAPHIC CAMERA

BACKGROUND OF THE INVENTION

Figure 1:
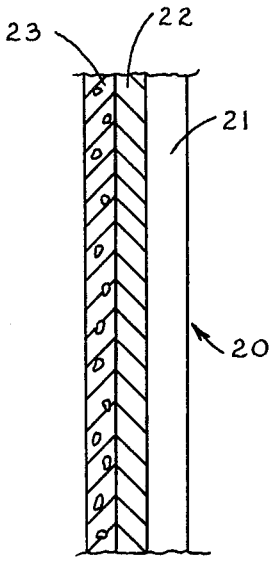

Electrophotographic techniques and processes for image reproduction are well known in the art. These generally involve use of an electro-photosensitive and electro-charge-dissipatable base upon and by which the image is retained and fixed by sequential steps that generally (and in simplest and most fundamental terms and concepts) include:

1. Sensitization or activation of the image-retaining electrophotographic base by charging, usually at uniform level over and in the entire surface, of its generally insulated photoconductive and charge-retaining surface or image bearing portion by electrostatic or equivalent means;

2. Imparting a latent image in the charged base by exposing it to a charge-dissipating influence, such as light, in such a manner as to obtain an image configuration (i.e., light and dark or shadow effects, as it were) influence or reproduction potential and capability therein whereby and wherein gradient or varying charge intensities and levels in configuration conforming relationship to the image being reproduced are realized by selective dissipation on or at any part or portion of the electro-photoconductive surface according to the relative intensity of the charge dissipating influence to match the desired image cast upon each given part or portion of the surface; then 3. Developing and fixing the exposed surface by depositing on the imaged layer a charge-responsive dye or pigment colorant (which includes black) or developing material, generally called a "toner," which remains in varying concentration or color-producing disposition according to the level of charge dissipating at any given part or portion of the electro-photoconductive surface in conformance with the latent image imposed thereon so that permanent reproduction of the image is achieved and obtained.

The phenomenon in its various techniques and aspects is well known and understood in the art and has been extensively described, in vast quantity and proportion, in considerably numerous patent and other literature sources. As cursory evidence of this reference may be had to U.S. Pat. Nos. 3,052,539; 3,249,430; 3,259,581; 3,383,209; 3,595,691; 3,660,086; 3,751,247; 3,758,305; 3,802,880; and 3,809,555 and the citations therein amongst the multitudinous additional teachings and disclosures available in the art (such as those included, inter alia, in International Search Classes GO3f, GO3g and so forth). Thus, no further fundamental elucidation or detailed description is necessary or required as to same for full comprehension and clear understanding of the present invention.

The present invention is generally applicable to electrophotographic reproductions that are made in either black (or other monochromatic color)-and-white but not well adapted for multiple or full color using any electro-photoconductive base that is suitable and satisfactory for the purpose (including, of course, the very popular paper composite bases even though other support substrate materials can be employed) that is capable of yielding either the so-called — and well understood in the art — continuous tone reproductions as well as with and for bases that are effective to make half-tone reproductions.

In this connection, it is well known and understood in the art that: (i) a continuous tone reproduction is an image, that is comprised of gradient tones ranging from a relatively absolute black to a relatively absolute white (with the equivalent analogy applicable when colors other than black are involved); while (ii) a half tone reproduction is an image that is comprised (either in black-and-white or color) or dots (or the like resemblances) which may vary in dot density distribution over a given area or in dot count taken along a given linear length and which are dissociated and distinct from one another and, in general, are of varying diameter. Pertinent background information which yields clear understandability of various aspects and definitions of the characteristics and features involved in and relevant to both continuous tone and half tone image reproductions may be found at pages 1,372 through 1,381 and 3,218 through 3,220, respectively, of the authoritative "Encyclopedia Of Photography," 1967 Edition, published by the Greystone Press of New York City.

Further along this line, a good standard reference in the electrophotographic field is "*Xerography And Related Processes*" by Dessauer and Clark, 1965 Edition, published by Focal Press.

The electro-photoconductive base, depending on its particular composition, construction and chracteristics, is ordinarily sensitized for image capture thereon by charging the electro-conductive layer thereof to a relatively uniform voltage intensity (without limitation in the indicated range) gradient from its lowermost to its uppermost image-retaining surface of between about 200 or less and about 1000 or more volts, with 400–700 volts being a common charge level encountered to provide the electrophoretic effect voltage retention and capability necessary to have for selective, image-conforming charge dissipation when subject to a given activating influence.

This induced charge will gradually and eventually dissipate with passage of time, the leakage rate being found to vary not only with the level of the induced charge but with the charge-retaining characteristics of any given base. Thus starting at the fully charged point in time, without any charge-dissipation caused by the activation influence, the base will decay to a literal "no-charge" (or inadequately charged level for effective image retention). In the ordinary printing procedure, it is generally advantageous for the totality of the activating influence to reach the proper degree of exposure to be applied well ahead of the ineffective decay point that is reached in normal charge loss dissipation on standing of the base without any image-impressing consequence of subjection to the activating influence. In fact, it is necessary that this be done before the normal decay point is reached if effective image fixing is to be achieved.

In this connection, it must be taken into account that various continuous as well as half tone reproducing capable electro-photoconductive bases exhibit various degrees or levels of "sensitivity" with respect to their capability of being activated so as to render and yield the desired tone and resulting image-retaining effect. This sensitivity can be measured and expressed by the number of steps reproducible on and discernable after exposure and fixing of the image in the base by comparisons made with and to the well known and standard Stouffer Grey Scale. The Stouffer Grey Scale has 21 light transmitting steps in the sequence of which maximum light transmission (or transparency) is Step No. 1 which is near if not at 100% in light transparency capability and minimum light transmission (or opacity) is Step No. 21 which is near if not at 0% in light transmitting capability, with gradations in light transmitting capability evident between 100 and 0% on a descending scale in intermediate Steps 2 through 20. An excellent quality reproducing base generally encompasses at least Steps Nos. 10 or 12 through 21 on the Stouffer Grey Scale, although lesser numbers of light transmitting capabilities according to Stouffer Grey Scale step effectiveness and measure can be utilized insofar as concerns sensitivity of a given base to render it in effect a satisfactory or at least operable image receiver and reproducer. Of course, reproduction capability according to the higher numbered steps is necessary in order to define and pick out the dark areas in a given reproduced image, whereas and conversely, some reproduction capability in the lower numbered Steps is mandatory for white or light areas to be discernable and copied in the reproduced image.

Thus, a base sensitive to and capable of operating in and over only five or six Grey Scale Steps may yield a satisfactory or even good image receiver, especially if the given limited number of Steps are well dispersed over the entire scale. In general, along this line, the reproduction to be of decent continuous tone quality should be capable of image reproduction so as to include: (i) for the "white" areas according to, say, at least one of the steps in the Steps Nos. 1–3 range of the Scale; (ii) for the "flesh and middle tone" areas at least one of the steps in the Steps Nos. 5–7 range of the Scale; and (iii) for the "dark and denser" areas of the reproduced image at least one of the steps in the Steps Nos. 11–21 range of the Scale. Accordingly, while it is conceivable to have a product which responds and corresponds to only two widely separate Steps, it is usually the case that the sensitivity of the base should be such that it is capable of responding to and reproducing at least three of the Steps of the Scale dispersed in the above-indicated range portions of the Scale.

As particularly appropos illustrations of suitable and relatively typical electro-photoconductive base materials and their composition and construction and colorants (such as "toners") and their formulation(s) which are more or less suitable for use and application, after appropriate adaptation, in and for practice of the present invention, reference may be had in addition to that indicated in the above-noted citations to the teachings and disclosures of U.S. Pat. Nos. 3,249,430; 3,259,581; 3,802,880; 3,804,619; and 3,809,555 plus Canadian Pat. Nos. 846,740; 846,741 and 846,742.

The surface of the image-retaining base is usually sensitized prior to exposure by means of subjecting it to electrical energizing fields, such as those provided by corona discharge means and effects (although, here too in other given systems other functionally equivalent sensitizing influences are adapted to and capable of employment).

Ordinarily, the latent-image retaining exposed base is most advantageously subject to the development and toning (or colorant-affixing) procedure and sequence that is utilized as soon as possible after exposure. Although some delay in the development after exposure is tolerable, the development or image-fixing procedure must perforce be commenced before dark decay of the base (by charge dissipation or leakage loss) becomes a problem. As is well known, the time for dark decay to occur after sensitization (and subsequent exposure) of a electrophotoconductive base varies with any given base according to its charge-retaining capabilities. Thus, knowing the decay rate of any given base allows one to determine what time period can be safely and acceptably tolerated between sensitization and exposure followed by development. Usually, at least about 1½ to 3 or 4 minutes (and sometimes as much as 5 to 10 or even more, depending on particularities of the base being utilized) is available between sensitization and image-fixing by development before dark decay goes to an undesirable extent (that ordinarily being a point at which the charge acceptance capability of the base has suffered a loss in the neighborhood of a 20–25% or so decrease).

FIELD AND OBJECTIVES OF INVENTION

The field in which the present invention resides and the improvement it pertains to, as well as the primary and general purposes to which it relates and the aims, objectives and advantages which it achieves, is the provision of a novel electrophotographic camera capabable of making on-the-spot, as it were, pictorial reproductions without external manipulations such as development and fixing so that exposed electrophotographic images of good quality and character in and of the pictorial product are obtained directly from and with the camera.

Practice of the present invention generally provides the desired and indicated results to an extraordinary and surprisingly remarkable degree with readily-apparent and quite pleasing functionality and practicality thereabout; all this being achieved without significant or tedious extraneous electrophotographic printing procedures being required.

The above-indicated and many more and other of the benefits and advantages in and obtainable by and upon practice of the present invention are more particularly set forth and easily evident in the ensuing specification, taken in connection with the accompanying drawing, wherein:

FIGS. 1–11, inclusive, made in graphical and schematic depiction, represent and illustrate various features and illustrations which are elucidative of a camera assembly according to the present invention.

FIG. 1 of the drawing schematically illustrates the structure of an electro-photoconductive base capable of yielding either continuous or half tone images so as to be adapted for utilization in practice of the present invention. The base structure, generally identified by reference numeral 20, has a support substrate 21 which generally is of paper although other suitable or desired materials of construction such as cloth, metal, plastic and so forth adapted to be overlay coated (and which frequently are most advantageously pliable in character particular if roll stock base is desired in the camera) according to commonly employed practices and procedures with an intermediate — or pre-coat — electroconductive resin or equivalent layer 22 (which, in effect, is the electrical ground element of the system) over which there is provided the uppermost layer or coating 23 which usually is comprised of a resin-bonded photoconductive pigment or equivalent inorganic or organic material (including suitable or desired mixtures of such photoconductive constituents) that is sensitizable by suitable means to build-up and contain an electrical charge so as to provide the suitable image-retaining surface which is actuated for latent image retention (actually, as indicated, through a charge-dissipating phenomenon) by the activating influence employed for the purpose.

Although other materials are known and capable of being employed, electro-photoconductive and photosensitive zinc oxide is a very popular, effective and extensively employed pigment for the resin-bonded photosensitive layer. Light, as mentioned, is a commonly employed activating influence to cast and impose the latent image on the electro-photoconductive base (although other and functionally equivalent activating influences are utilized in other given systems). The surface of base 20 is usually activated or sensitized by means of exposure to electrical energizing fields, such as those provided by corona discharge means and effects (although, here too, in other given systems other functionally equivalent sensitizing influences are adapted to and capable of employment).

Figure 2:
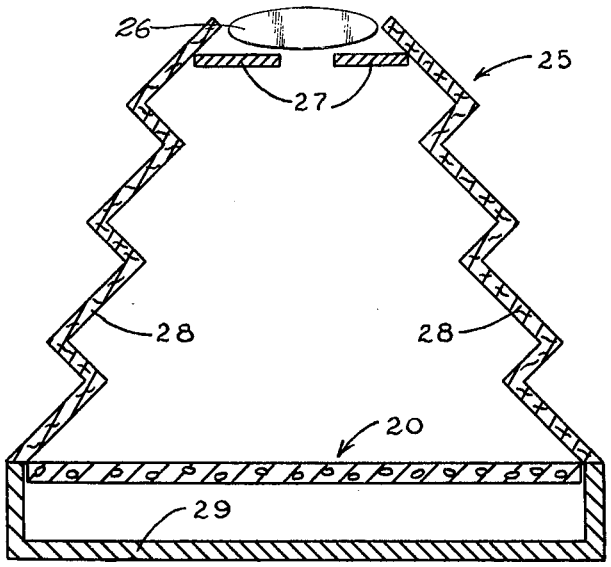

With reference to FIG. 2 of the drawing, there is very figuratively and schematically shown in cross-section a camera assembly, designated generally by reference numeral 25, which is illustrative of an assembly in accordance with the invention. The camera has a support housing section 29 in which the photoelectroconductive base material 21 is held during exposure. Enclosing bellows or sidewalls 28 extend from housing 28 to the lens 26 and shutter 27 in assembly for making the exposure. The operation is in general the same as with any other camera. The exposure of the subject to be photographed is made through the lens/shutter combination casting the light carrying the image on the base. The only difference of substance involved is that, as further more clearly described and explained in the following, the electro-photoconductive base is fixed and developed within the camera so that a finished electrophotographic print is therein obtained.

In this connection, the best and most advantageous form of base 20 to utilize is one having a more or less optical response that is, in effect, geared to that of the average human eye. Many zinc oxide papers are of such variety. The actual ASA speed of the ordinarily suitable electroconductive bases utilized depends to a great extent on the type of light that is employed for making the exposure. Thus, it quite often occurs that the ASA speed of an electro-photoconductive base in artificial (frequently from tungsten filament) light, which generally is richer in the reddish wave lengths, is about 5 or so. Yet is can be much faster if exposure is assisted with stroboscopic light sources which are usually on the order of 100 or so times more intense than tungsten filament. On the other hand, the speed of the same or similar paper exposed in sunlight, generally richer in green wave length values, is about 10 or so. Another factor in the ASA speed of an electro-photoconductive base is the actuating charge actually imposed thereon; with higher charges usually causing a faster decay rate which translates, in practical measure and concept, to faster or higher speed base.

For purposes of comparison with silver-based photographic films, the standard "Verichrome" film obtained from Eastman Kodak Company usually has an ASA rating of about 34; while Kodak's "Panatomic X" (fine grain) is ordinarily about ASA 25; "Royal Pan" also about ASA 25; "Plus X" panchromatic medium grade film about 125; and very high speed "Triple-XXX" is now generally of an ASA rating of about 400. Kodak also makes a commercially available autopositive silver-type paper for direct positive photography which has an ASA rating of about 40.

Thus, it is generally prudent with the electrophotographic cameras of the present invention to use longer exposures or greater lens settings, or both, than employed in and with cameras using ordinary silver-type films. This of course, is generally of no great handicap or concern in view of and upon balance with the great benefits and advantages realizable in and with cameras in accordance with the present invention.

Figure 3:
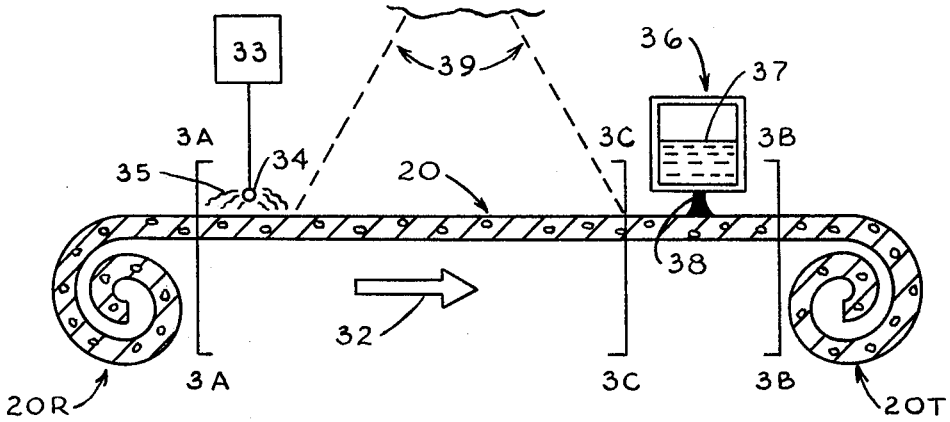

FIG. 3 of the drawing schematically illustrates with greater particularity the combination construction of a camera, designated generally by reference numeral 31, in accordance with the invention. As shown only diagrammatically in FIG. 3, the electro-photoconductive base material 20 can be handled along conventional lines in spooled or roll form wherein the unexposed supply is contained in coiled storage 20R and the exposed and developed portion may be taken up in coiled storage 20T! Advance of the base 20 in the direction of arrow 32 to bring unexposed lengths in exposing position under the image-bearing pattern of the exposing light (shown in dotted outline and designated generally by reference numeral 39) may be by any conventional means strip or film-advancing means. And, of course, it is oftentimes most desirable (instead of storing the exposed and fixed image-retaining base in a wound-up condition until all of the supply is used before taking the electrophotographic reproductions) to eliminate — although this is not illustrated in FIG. 3 — the wound take-up supply 20T and more simply and directly, with maximized desirability to the user, to have means (not shown) for simply cutting, slicing or tearing off each exposed and developed length of the base so that instant photoelectric print or pictures are available and obtained shortly after exposure in the picture-taking process.

For purposes of most simply and directly elucidating other features in the subsequent views and depictions portrayed in the several remaining FIGURES of the Drawing, Section Lines 3A—3A; 3B—3B; and 3C—3C are inserted in FIG. 3. Section Line 3A is positioned after the point of base material 20 feed ahead of the actuating means therefore in the camera. Section Line 3B—3B is disposed just before the exposed and fixed image-retaining base outlet from the camera; and Section Line 3C—3C is ahead (with respect to direction of base 20 advance) of Section Line 3C—3C before the place where the means utilized for developing and fixing the exposed base 20 are positioned.

Looking to the fixing and developing portion in FIG. 3 between Section Line 3B—3B and Section Line 3C—3C, there is located one means (figuratively illustrated) for applying the charge-responsive colorant (ordinarily called a toner). As shown, the toner is contained in a storage unit or chamber, indicated generally by reference numeral 36, which holds the toner supply 37 which is put on the exposed base 20 by means of a suitable applicator (such as a wick, brush, sponge unit, blotter-pad or the like) 38 which is in contact with or close enough promixity to the base to feed in appropriately metered quantity the toner from supply 37 to the surface of exposed base 20 so that the latent image is fixed and developed thereon to yield the desired electrophotographic reproduction. Actually, sponges and blotter pads or the like with self-sufficient supplies of toners can also be utilized, thereby eliminating any need for a back-up supply system.

Figure 4:
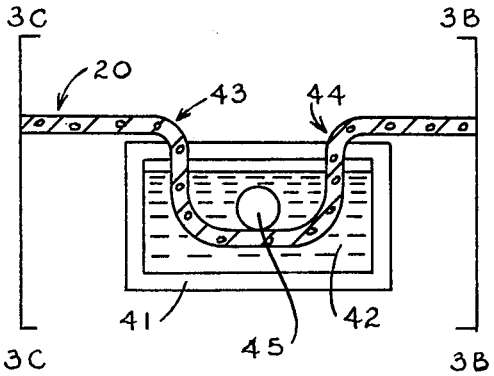

Other means for applying the colorant material for fixing the image on the base can also be utilized, such as storage pads therefore with associated means to break them for appropriate application on the exposed base; spray means, and so forth. In fact, as shown in FIG. 4, the exposed base 20 may be passed through a dip or bath of toner liquid 42 held in a container 41 therefor having inlet and outlet ports, generally designated by reference numerals 43 and 44, respectively with, if optionally desired, a guide roller or bar 45 to ensure proper submission of the exposed base 20 in the toner for adequate image fixing.

In general, satisfactory toner colorants are pigments or dyestuffs (or combinations thereof) that are coated with usually a plastic or resinous binder and dispersed in a suitable mineral spirit or normally liquid hydrocarbon material from petroleum or the like with (although other additives of a charge-responsive nature or having other desired characteristics may also be present) a very minor proportion — almost in trace quantities on the order of 1 – 1,000 ppm by weight and more often between about 10 and 50 ppm — of charge control or directing agents which tend to direct and accurately control good deposition and lay-down of the colorant during latent image development and fixing.

Many of a wide variety of organic and inorganic pigments and/or dyestuffs may be utilized as the colorant in the toner including such materials as various carbon blacks; asphaltums; specific and oftentimes proprietary materials such as the colorants "Phthalocyanine Blue," "Rhodamine B," "Benzidine Yellow" and so forth; various oxides, sulfates, sulfides, carbonates, phosphides, phosphates, nitrates, nitrites and the like of alkali metals, alkaline earth metals, a large number of the heavy metals and, frequently, organic derivatives of the straightforward inorganic pigment colorants; and so forth. Likewise, in order to obtain satisfactory coated pigment and/or dyestuff materials for toner colorant usage, many of a wide variety of usually resinous or plastic (most often thermoplastic and fusible) binder materials can be employed including, for purposes of illustration, various vinyl resins, regular and modified acrylic resin polymers, methacrylates (including the methyl, methyl/n-butyl, ethyl, butyl, etc., varieties) regular and modified alkyd resin types, vinyl acetate polymers, vinyl butyral polymers, and so forth. Usually, the pigment to binder ratio in a toner colorant is such that there is between about 2 and about 10, more commonly 6 – 8, parts by weight of binder(s) to each part by weight of the pigment or dyestuff in the composition (with mixed pigment and/or dyestuff as well as mixed resin binder systems being possible to utilize); with the total solids dispersed in the mineral spirit vehicle ordinarily, on a percent by weight basis, no more than in the range of 0.2 to 1.5 percent taken on total toner composition with solids in the range between about 0.3 and about 1.1 percent by weight being more typical. Of course, toner concentrates can be and in practice are prepared in which the resin coated colorant with other additives combined is prepared for dispersion in the solvent at the appropriate desired concentration for toner usage.

As with the pigments or dyestuffs and resin binders therefor, many of a wide variety of suitable charge control agents are suitable for use in toner compositions. Typical of these are cobalt naphthanate, manganese octosol, (scientifically boiled) linseed oil, asphaltum, ollyl acid phosphate and the like and equivalent materials. As is above indicated, the toners generally employ only literal trace amounts of the charge control agent(s), with maximum ranges involved for at least rough comparison with those above specified in ppm being, on a weight percent based on total solids in the toner, between about 0.1 or 0.15 to 0.3 or 0.4 percent.

It is usually desirable to employ a predominantly aliphatic type normally liquid hydrocarbon mineral spirit material as the solvent or vehicle in the toner composition. Good illustrations of these are the paraffin and isoparaffin types and varieties, such as those in the approximate $C_{16}$ range and which are known and available under such trade designations as "Isopar G;" "Isopar H;" "Shell Sol 400;" "Shell Sol 70;" and "Shell Sol 71," although sometimes solvents with such constituents as the toluenes, ethyl benzenes, methyl ethyl ketones and the like and even aromatic mineral spirits may be employed, including such commercially available materials as "Shell Sol 53" and "Shell Sol 63." It is ordinarily desirable for the mineral spirit solvent employed, however, to contain not more than about 10 weight percent, preferably less than 5 percent by weight, of aromatic constituent in the toner composition and for it to have a solubility parameter range according to the well-known and conventional conception the numerical order between about 4 to 15, especially in the more narrow area between about 6 and 10.

On development and fixing of latent image in electrophotographic processes, toner compositions usually are considered to become more or less ineffective and spent or depleted when about one-half or so of the original solids content is deposited out of the composition as a colorant for the electrophotographic copy reproduction(s) being made; this consideration being of course applicable to liquid toner systems. In the case of pictorial (rather then line copy) reproductions, this can happen as quickly as the fifth or so print of approximate maximum 5 × 7 inch reproduction using a toner bath volume of about 1,000 cc's. with a solids concentration in a given toner on the order of 0.7 weight percent of involved composition. Thus, care should be taken in being sure that enough effective toner, however supplied, is available in the camera to process the exposed base being exposed and developed therein.

Very advantageously for use with the camera of the present invention, a toner paste (instead of a liquid) is utilized. Such a paste should have a normal room temperature viscosity in the range between about 100 and 1,200–1,500 centipoise, preferably between about 500 and 1,000 centipoise. This allows for a more compact and frequently easier to handle, disperse and apply toner supply in the camera. Sometimes when toner paste colorant systems are utilized, specially matching colorant systems are required to accommodate the generally high flash point solvents usually most advantageous to utilize with a paste, such solvents ordinarily having a flash point above about 100° F. and, more advantageously, up to the neighborhood of 150° F. or so (the "Freons" being good examples of these). Oftentimes it is found that the most desirable toner pastes to employ are those having about a 1:5 pigment to binder ratio in the colorant admixed with proper proportions of of solvent to get desired viscosity. One salient and particularly beneficial advantage of using toner paste, especially one of a high viscosity grade, is the facility with which it permits the exposed base 20 to "slip through," as it were, the colorant without any necessity or desirablility for a subsequent mechanical or liquid cleaning step. Frequently, and oftentimes disadvantageously, when ordinary toners are used, the base can pick up undesired quantities of extraneous and unnecessary deposited material which ordinarily is better removed by such expedients as washes, and so forth. Toner pastes usually obviate any such necessity or optional desirability.

While any desired hue can be utilized for and in the colorant, black is by and large the most popular and desirable toner to employ in order to obtain black-and-white electrophotographic reproductions in the camera.

Referring back now to FIG. 3, there is shown between Section Lines 3A—3A and 3C—3C and ahead of the impinging path 39 of exposing light on base 20 a corona discharge means 35 for activating the base 20 to ready it for exposure. This must be energized by a suitably high source of voltage to ensure sufficient activation to get adequate latent image-retention capacity in the base used in the camera. Along this line, while some electro-photoconductive bases can "image" with charge gradients thereacross that are as low as 60 volts or so, it is more often the case that the base need be charged to somewhere around the minimum 150 to (as mentioned) 200 volt range for optimum results.

In this connection, the voltage intensity of the corona discharge source must be adequately high (depending on extent of air gap involved and the nature of the base being activated) to impart the desired charge in the base so that it has a useful latent image-retaining capacity for the exposure to be made. Thus, in providing the necessarily adequate voltage for effecting the corona discharge to be employed, one must observe and take into account (in order to arrive at proper gap spacing within practical and attractive physical limits and compactness features of the camera embodiment without undesirable exaggerations thereof and therein) that the dielectric breakdown point of air — which must be overcome before charge from the corona discharge can be effectively imparted to the base — is 50 volts per mil (or 0.001 inch) which is equivalent to 25 microns. Thus, if the corona discharge wire element 34 (as depicted in FIG. 3) were spaced at only a micron distance from the base 20 being activated, at least 2 volts of corona discharging intensity would be required to get any charge at all into the base. In this, as is obviously generally recognized and understood, the voltage applied "looks," as it were, to the total impedence involved in order to be effective so that, naturally, the portion of impedance contributed by air gap cannot be ignored. In addition to that, the ordinarily utilized and involved activatable electro-photoconductive base is a plastic coated paper material having a usual overall thickness of about 3 mils. This then (even disregarding other impedance-contributing dielectric features that may be inherent in the base requires that at least an additional 150 volts or so must be in the corona discharge before any activation of the base 20 for its subsequent latent image-retaining exposure. But, because the electro-photoconductive base 20 itself generally has dielectric values greater than air, the usual impedance to overcome in activating the base is unavoidably shifted upwardly and generally is such that considerably greater overall dielectric breakdown voltages must be regarded, these commonly being of an order of magnitude such that at least 200 volts per micron or 5,000 volts per mil must be handled.

In any event, electrical storage and discharge apparatus and means to effectuate such necessary voltages for adequate corona discharge effects are well within the skill of the art for utilization in and with a camera in accordance with the present invention. As is well known, they can include small electrostatic generators; battery/capacitor (oftentimes referred to as "RC") circuitry analagous to the type utilized in ordinary photography light illuminating flash equipment; and so forth.

Thus, FIG. 3 schematically particularly depicts the suitable high voltage electrical energy source 33 supplying wire element 34 to create the corona discharge field 34 which is of sufficient voltage intensity and strength to overcome all involved dielectric breakdown impedances so that the base 20 is provided with adequate activating electrical charge to give it its necessary latent image-retaining characteristics.

Of course, when electrical systems are desired to be utilized for base-charge-inducing purposes, even such adequately voltaged means and embodiments as electrode brushes or other physically contacting electric charge applicating elements can be employed — being careful in the usage of such that no physical damage of the surface of base 20 is encountered or made likely to happen. External power supply input is, of course, possible.

Figure 5:
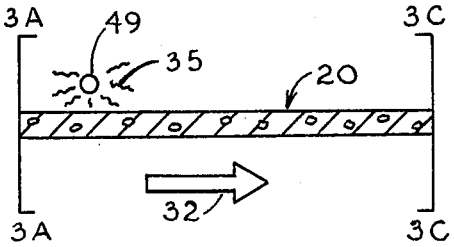

An alternative to electrical charging is shown in FIG. 5 of the drawing. Thus a rod 49 or other appropriate physical embodiment of a suitable and safe radioactive material (such as strontium-90 or the like or equivalent materials) may be utilized to generate the charge-imparting and transmitting field 35 for activating base 20.

Figure 6:
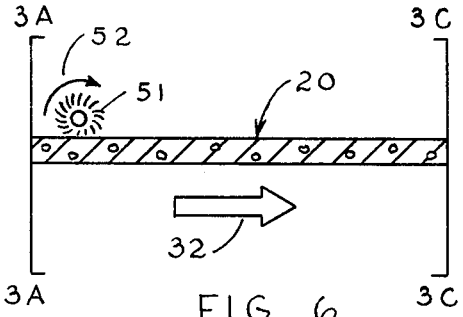
Figure 7:
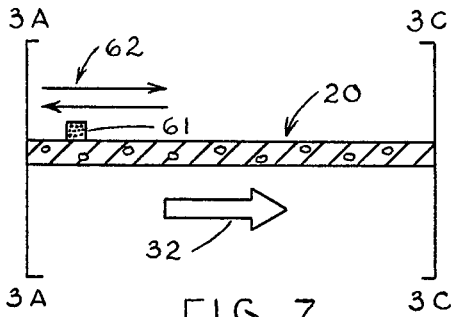

Other means for imparting electrical charge to base 20 for its activation in camera embodiments according to the present invention may also be utilized. These include such mechanical adaptations as are shown in FIGS. 6 and 7 of the Drawing. Thus, a generally soft and necessarily non-abrasive charge generating mechanical contact effect can be utilized for electrostatically generating the requisite charge in the base 20 to render it electro-photoconductive — this following the well known and very old principles of so-called electrostatic attraction which go at least so far back in history as the time circa 640–546 B.C. when the Greek philosopher Thales observed that a piece of amber when rubbed with cloth was able to attract lightweight objects in close promixity to the thereby charged amber.

Accordingly, a frictional charging member capable of imparting a negative charge to the base 20 upon dynamic mechanical contact (cat's fur elements, suitably configured chamois cloth constructions and the like being good illustrations of suitable means for the purpose) may be employed. FIG. 6 illustrates this in the form of a brush or roll 51 rotated in contact with base 20 at a high rate of speed in the direction of arrow 52 (or opposite). FIG. 7 shows an alternative to this wherein the mechanical rubbing with the appropriate charge-inducing element is done by a brush 61 or other frictional electrical-charge generating element of a material capable of being so effective is passed quickly and rapidly enough using appropriate mechanically reciprocating means for the purpose back and forth, as indicated by directional arrows 62, so as to get the base 20 activated. In this, the reciprocating stroke may be over the entire portion of base 20 to be exposed when it is advanced fully to ready-for-exposure position or to lesser extents, if so desired, so as to activate base 20 while it is being advanced into such position.

An extremely advantageous technique to employ in practice of the present invention is to utilize a pre-activated base already having electric charge therein before insertion for exposure, etc., use in the camera. This can be accomplished in several ways as is or will become evident to those skilled in the art and can be utilized with a rolled supply of base to be exposed or, if desired and as is readily comprehendable insofar as any practical embodiment (including those illustrated and disclosed above of the camera of the present invention is concerned), with the electro-photoconductive base 20 being supplied and utilized in the form of sheet stock according to and utilizing conventional film slide and holder techniques for the purpose.

Figure 9:
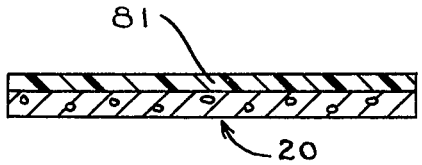

Thus, as shown in FIG. 9, the base 20 can be covered with a sheet or film 81 of very high dielectric material (such as "Mylar" or the like and equivalent polyester and equivalent materials or "Teflon" or the like and equivalent fluorocarbon polymers and plastics and similar and analogous dielectric substances capable of being fabricated into sheet or film form and generally having dielectric strength characteristics and values of at least 300–500 volts per mil) after having been activated prior to the covering or activated with the covering already applied — using sufficient voltage in the latter event to accomplish the desired pre-activation. A pre-charged covered base eliminates use of or need for internal activating means in the camera; and such protected bases have practical longevity and sufficiently adequate shelf or storage life to be attractive and desirable for use in cameras according to the present invention. In this connection, low humidity storage of a protected, preactivated electro-photoconductive base material tends to significantly prolong the useful like thereof (i.e., reaching to the point where charge dissipation and decay is so far gone as to deprive the base of useful latent image-retaining properties and capabilities upon exposure to activating, image-bearing and transmitting sources, such as light). Hermetically sealed, relatively air-proof packages which may or may not be under vacuum so long as the atmosphere therein is dry are advantageously employed for storage of pre-activated base prior to its use. If desired, such packages according to conventional known techniques may even contain added dessicant material(s), such as silica gel, to assist in maintenance of a dry atmosphere within the storage package.

An advantage of and in a dielectric film or sheet-covered and protected pre-activated base is that, in use, the voltage on the dielectric cover usually is such that it actually tends to break down air gap effects so as to further enhance the charge-retaining capability of the pre-activated base involved.

Figure 10:
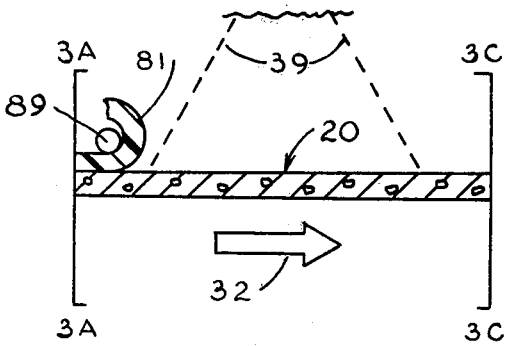

Before actual exposure use of a pre-activated base, the protective dielectric cover is stripped away. This may be done before feeding the base to the camera or, if desired, by means actually embodied within the camera for that purpose. FIG. 10 of the drawing particularly illustrates one such possibility of the latter. The dielectric protective cover 81 is stripped away from the base 20 during its advance into exposure position by any suitable means, such as reverse passage over a bar or roll 89 for discard in any desired manner.

Figure 8:
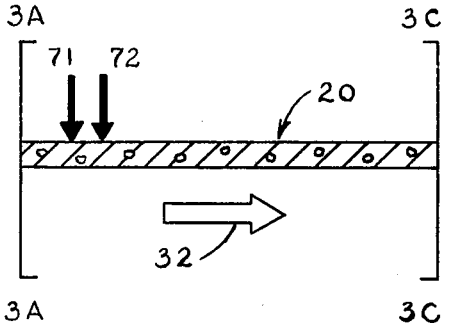

Other reagents and base-treating materials can be applied on the base before or after exposure for the advantageous effects they contribute in suitable means to handle and dispense them embodied within a camera according to the present invention. Thus, as illustrated in FIG. 8, a pre-exposure application of solvent to better condition the base for clear image reproduction after exposure and development fixing and retaining with the colorant may be made at the point indicated by arrow 71 ahead of the point (if employed) of internal activation indicated by arrow 72. This advance solvent application is for the purposes and may be practiced with accordance to the teachings and disclosures of co-pending application Ser. No, 506,734, filed Sept. 16, 1974 of Edward T. Bradley (one of the applicants in the present application) entitled "TECHNIQUE FOR PROCESSING PHOTOGRAPHIC REPRODUCTIONS ON COLORANT-SENSITIZED ELECTRO-PHOTOCONDUCTIVE PAPER." Any suitable liquid applying means including those discussed in the foregoing may be used for the purpose.

Figure 11:
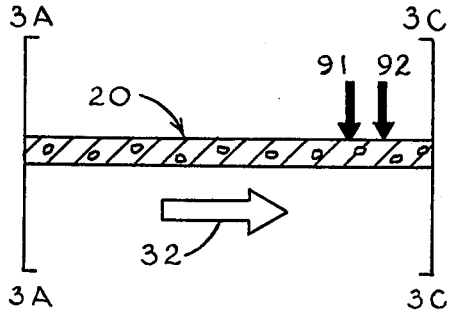

Analogously and beneficially, if desired, protective coating application for the fixed and developed picture reproduction may be applied as illustrated in FIG. 11 within the camera at the point designated by arrow 92 after the point of colorant application designated by arrow 91. Such protective coatings for the developed image are well known in the art and, quite frequently, are acrylic or like or equivalent resinous materials applied from lacquer or like formulations directly in liquid state or by means of aerosol or equivalent spray applicating technique.

Of course, general use of cameras in accordance with the present invention is analogous to that employed for conventional cameras at least in connection with such particulars as viewing, focusing, exposure time and so forth.

As is readily apparent and will be appreciated by those skilled in the art, many changes and modifications can be easily and without extraordinary effort made and adapted in embodied techniques and practices in accordance with the present invention and without substantially departing from its intended spirit and scope, all pursuant to and in accordance with the same as it is set forth and defined in the claimed subject matter appended hereto.

What is claimed is:

1. A camera comprising: a camera housing: lens means at the front of said camera housing for projecting a light image on a field at the rear of said camera housing; electrophotographic print material having an electrically charged electrophotoconductive surface, said charged surface being covered with a sheet of dielectric material; print support means in and at the rear of said camera housing in line with said lens means for holding an electrophotoconductive base in the field of said lens means such that the lens means projects its image to be photographed thereonto; shutter means mounted in said camera housing between said lens means and said support means for selectively opening and closing said lens means relative to said print support means; advancing means in said camera housing for advancing said electrophotographic print material from one side of the field of vision of said lens means, through said field of vision of said lens means and out of the field of vision of said lens means; sheet removal means in said camera housing upstream from the field of said lens means relative to the direction of advancement by said advancing means whereby said sheet of dielectric material is removed from said print as said print is advanced by said advancing means into the field of said lens means; toner applicator means in said camera housing adjacent said advancing means and out of the field projected by said lens means for applying toner to the exposed print as it is advanced by said advancing means; said housing including means facilitating removal of said print therefrom following its development.

2. The camera of claim 1 in which said dielectric material comprises a polyester plastic film.

3. In the camera of claim 2 wherein said toner applicator means are adapted to dispense a liquid toner.

4. In the camera of claim 2 wherein said toner applicator means are adapted to dispense a toner in paste form.

5. The combination of claim 2, embodying in added combination and further association therewith: pretreating means mounted in said camera housing upstream, relative to the direction said electrophotographic print is advanced by said advancing means, of the field of exposure of said electrophotographic print in said camera for applying a surface-treating solvent to the surface of said base to facilitate its subsequent fixing and development.

6. The combination of claim 2, embodying in added combination and further association therewith: coating means adjacent said toner applicator means and downstream therefrom in the direction in which said electrophotographic print is advanced by said advancing means for applying protective coating of the fixed and developed exposed base.

* * * * *